US006177757B1

(12) United States Patent
Enomoto et al.

(10) Patent No.: US 6,177,757 B1
(45) Date of Patent: Jan. 23, 2001

(54) IMAGE DISPLAY APPARATUS WITH INTEGRALLY REAR PLATE AND SUPPORT BODIES

(75) Inventors: Takashi Enomoto; Takashi Nishimura, both of Fukaya (JP)

(73) Assignee: Kabushiki Kaisha Toshiba, Kawasaki (JP)

( * ) Notice: Under 35 U.S.C. 154(b), the term of this patent shall be extended for 0 days.

(21) Appl. No.: 09/086,406

(22) Filed: May 29, 1998

(30) Foreign Application Priority Data

May 30, 1997 (JP) ..... 9-142555

(51) Int. Cl.[7] ..... H01J 31/00

(52) U.S. Cl. ..... 313/2.1; 313/292; 313/493; 313/243; 313/477 R; 445/24

(58) Field of Search ..... 313/1, 2.1, 292, 313/458, 238, 243, 244, 114, 460, 477 R, 482, 402, 476, 495, 496, 497, 422; 445/24, 25

(56) References Cited

U.S. PATENT DOCUMENTS

| | | | | |
|---|---|---|---|---|
| 5,287,034 | | 2/1994 | Kamohara et al. . | |
| 5,547,483 | | 8/1996 | Garcia et al. . | |
| 5,589,731 | | 12/1996 | Fahlen et al. . | |
| 5,751,094 | * | 5/1998 | Nishimura et al. | 313/2.1 |
| 5,831,372 | * | 11/1998 | Seino et al. | 313/2.1 |
| 5,831,373 | * | 11/1998 | Takahashi et al. | 313/2.1 |
| 5,888,112 | * | 3/1999 | Alwan | 445/24 |
| 5,952,767 | * | 9/1999 | Kuwabara et al. | 313/2.1 |
| 5,961,360 | * | 10/1999 | Nishimura et al. | 445/24 |

FOREIGN PATENT DOCUMENTS

| | | |
|---|---|---|
| 634775A1 | 1/1995 | (EP) . |
| 9-134684 | 5/1997 | (JP) . |

OTHER PUBLICATIONS

Patent Abstracts of Japan, vol. 097, No. 004, Apr. 1997, re JP 08339771.
Patent Abstracts of Japan, vol. 017, No. 319 (E–1383), Jun. 1993, re JP 05036363.
Patent Abstracts of Japan, vol. 017, No. 160(E.1342), Mar. 1993, re JP 04322044.
Patent Abstracts of Japan, vol. 006, No. 234 (E–143), Nov. 1982, re JP 57136731.

* cited by examiner

*Primary Examiner*—Michael H. Day
*Assistant Examiner*—Mariceli Santiago
(74) *Attorney, Agent, or Firm*—Pillsbury, Madison & Sutro LLP

(57) ABSTRACT

An envelope of a cathode ray tube includes a substantially rectangular flat face plate, and a substantially rectangular flat rear plate opposed to the face plate with a side wall being interposed therebetween, a plurality of funnels extending from the rear plate. A plurality of necks extend from the respective funnels, and a plurality of electron guns are respectively arranged in the necks. A plurality of plate support portions are arranged between the rear plate and the face plate, so as to support the rear plate and the face plate against an atmospheric pressure. Each plate support portion includes a support body made of glass which is integrally welded with the rear plate and extends from the rear plate toward the face plate, and a distal end portion jointed to the extending end of the support body and being in contact with the face plate.

26 Claims, 9 Drawing Sheets

IMAGE DISPLAY APPARATUS WITH INTEGRALLY REAR PLATE AND SUPPORT BODIES

BACKGROUND OF THE INVENTION

The present invention relates to an image display apparatus which comprises a flat face plate having a phosphor screen on the inner surface thereof, a flat rear plate opposed to the face plate, plate support portions arranged between the face plate and the rear plate to support an atmospheric pressure load, and an electron emission portion provided on the rear plate, and relates to as well as a method of manufacturing the image display apparatus.

In recent years, various discussions and studies have been made in relation to high-definition broadcasting or an image display apparatus of a high resolution having a large screen which responds to such broadcasting. For example, in a cathode ray tube serving as the image display apparatus, in order to achieve a high resolution, the beam spot diameter of each electron beam on the phosphor screen must generally be reduced.

In this respect, improvements in the electrode structure of an electron gun or enlargement and extension of the diameter of an electron gun itself have been attempted, but have not reached satisfactory results. This is because the distance from an electron gun to a phosphor screen increases as the size of a cathode ray tube is enlarged, so that the magnification of the electron lens is enlarged too much. Therefore, the distance (or depth) from an electron gun to a phosphor screen must be reduced to achieve a high resolution. In addition, a widened deflection angle of an electron beam leads to an increase of a difference in magnification between the center of a screen and the periphery thereof. Deflection at a widened angle is thus not a better way to achieve a high resolution.

Hence, developments have been made to a cathode ray tube as a solution for the problem of a conventional cathode ray tube as described above, for example, Japanese Patent Application KOKAI Publication No. 5-36363 discloses a cathode ray tube wherein a face plate and a rear plate are flattened, and a plurality of regions of a phosphor screen with an integrated structure formed on the inner surface of the face plate are dividedly scanned by electron beams emitted from a plurality of electron guns which are attached to the rear plate.

More specifically, this kind of cathode ray tube comprises a flat face plate and a rear plate made of glass and opposed in parallel to each other, and a side wall made of glass is joined to the periphery of the face plate so as to extend vertically, for example, using a joining material such as frit glass or the like. The rear plate is fixed to the face plate through the side wall. A plurality of rectangular openings are formed in the rear plate, corresponding to a plurality of regions to be scanned dividedly. Also, a plurality of funnels are fixed by a joining material, to the rear plate so as to surround the respective openings, and the electron guns are respectively arranged in the necks of the funnels. Further, a plurality of plate support members are disposed between the face plate and the rear plate and support the face and rear plates against an atmospheric pressure load. Each plate support member is formed of metal in a columnar shape and has a base end joined to the inner surface of the rear plate by frit glass or the like and a top end in contact with the inner surface of the face plate.

Further, a plurality of regions of the phosphor screen with an integrated structure formed on the inner surface of the face plate are dividedly scanned by electron beams emitted from the plurality of electron guns. Images respectively displayed on the regions by the divisional scanning are connected together by controlling signals applied to the electron guns or deflectors equipped so as to correspond to the electron guns, so that a seamless image is reproduced over the entire regions of the phosphor screen, without an overlap.

In the image display apparatus comprising a plurality of plate support members as described above, the plate support members must be correctly arranged at predetermined positions and the heights of the top end portions thereof must be aligned uniformly in order to efficiently support the face plate and the rear plate by the plate support members.

However, in a conventional image display apparatus, it is difficult to align heights of all the plurality of plate support members and it is also very difficult to join the plate support members precisely without displacements because each plate support member is joined to the rear plate by a joining material.

Further, in a cathode ray tube wherein a plurality of regions of the phosphor screen are dividedly scanned by electron beams emitted from a plurality of electron guns, as described above, the electron guns must be correctly situated at predetermined positions such that the axes of the electron guns pass through the respective centers of the corresponding regions, in order to set the raster of each region to a predetermined size and thereby to obtain an image without seams and overlaps between adjacent regions.

However, in the conventional cathode ray tube, it is very difficult to join a plurality of funnels to the rear plate with high precision such that the axes of the electron guns enclosed in the necks of the funnels pass through the respective centers of the regions. Further, the plurality of funnels and the side wall must be fixed to the rear plate made of glass by a joining material. The joining portions thereof decrease positional precision of its respective components, as well as reliability concerning the ability to withstand-voltage and maintain vacuum-air-tightness.

BRIEF SUMMARY OF THE INVENTION

The present invention has been made in consideration of the above circumstances and it object is to provide an image display apparatus in which a plurality of plate support portions are arranged and formed with high precision, and to provided a method of manufacturing the same.

Another object of the present invention is to provide an image display apparatus in which a plurality of plate support portions are arranged and formed with high precision so that the device's ability to withstand voltage and vacuum air-tightness is improved, and to provided a method of manufacturing the same.

To achieve the above objectives, an image display apparatus according to the present invention comprises: an envelope including a substantially rectangular flat face plate having a phosphor screen formed on an inner surface thereof, a substantially rectangular flat rear plate opposed to the face plate with a side wall being interposed therebetween, a plurality of funnels extending from the rear plate, a plurality of necks extending from the respective funnels, and a plurality of plate support portions arranged between the rear plate and the face plate, for supporting the rear plate and the face plate against an atmospheric pressure; and a plurality of electron guns respectively provided in the necks, for dividedly scanning a plurality of regions of the phosphor screen.

Each of the plate support portions includes a support body made of glass, which is integrally welded with the rear plate and extends from the rear plate toward the face plate.

Another image display apparatus according to the present invention comprises: an envelope including a substantially rectangular flat face plate having a phosphor screen formed on an inner surface thereof, a substantially rectangular flat rear plate opposed to the face plate with a side wall being interposed therebetween, and a plurality of plate support portions arranged between the rear plate and the face plate, for supporting the rear plate and the face plate against an atmospheric pressure; and an electron emission section provided on the rear plate, for emitting an electron toward the phosphor screen.

Each of the plate support portions includes a support body made of glass, which is integrally welded with the rear plate and extends from the rear plate toward the face plate.

According to the present invention, a method of manufacturing an image display apparatus comprising a substantially rectangular flat face plate having a phosphor screen formed on an inner surface thereof, a substantially rectangular flat rear plate opposed to the face plate with a side wall being interposed therebetween, a plurality of funnels extending from the rear plate, a plurality of necks extending from the respective funnels, a plurality of plate support portions arranged between the rear plate and the face plate to support the rear plate and the face plate against an atmospheric pressure, and a plurality of electron guns for dividedly scanning a plurality of regions of the phosphor screen, is characterized by comprising steps of: heating support bodies made of glass and the rear plate, to a temperature equal to or higher than a softening point of glass, so as to weld an end of each of the support bodies to an inner surface of the rear plate.

According to the image display apparatus and the method of manufacturing the same constructed as described above, the support bodies of the plate support portions need not be joined with use of a joining material, but are formed of glass to be integral with the rear plate. Therefore, it is possible to align uniformly the heights of the plate support portions, and to position the plate support portions at predetermined positions with high precision. As a result of this, an atmospheric pressure load acting on the vacuum envelope can be supported effectively, so that a light-weight strong image display apparatus can be realized. Also, it is possible to reduce use of special metal materials for plate support portions and to reduce the number of assembling steps, so that the manufacturing cost can be reduced.

In addition, according to the image display apparatus and the manufacturing method thereof, the rear plate and the funnels need not be joined by a joining material, but are integrally formed of a plate glass. Therefore, a plurality of funnels are positioned on the rear plate with high precision. As a result, axes of electron guns enclosed in the necks of the funnels can respectively be arranged so as to pass through the centers of the regions to be scanned dividedly by electron beams. By thus adopting integral formation, joining surfaces of respective components are reduced so that reliability concerning voltage-withstand characteristics and vacuum air-tightness are greatly improved, and costs of materials and manufacturing steps associated with joining of components are reduced.

Also, according to the image display apparatus of the present invention and the method of manufacturing the same, the rear envelope is constructed by integrally forming a rear plate, a plurality of funnels, and a side wall from glass. In this case, the joining surfaces of respective members are smaller than conventional devices, so that the reliability concerning the ability to withstand voltage maintain and vacuum air-tightness can be improved and the cost manufacturing is reduced.

Additional objectives and advantages of the invention will be set forth in the description which follows, and in part will be obvious from the description, or may be learned by practice of the invention. The objects and advantages of the invention may be realized and obtained by means of the instrumentalities and combinations particularly pointed out hereinbefore.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments give below, serve to explain the principles of the invention.

DETAILED DESCRIPTION OF THE INVENTION

In the following, explanation will be made of a first embodiment in which an image display apparatus of the present invention is applied to a cathode ray tube, with reference to the drawings.

Figure 1:
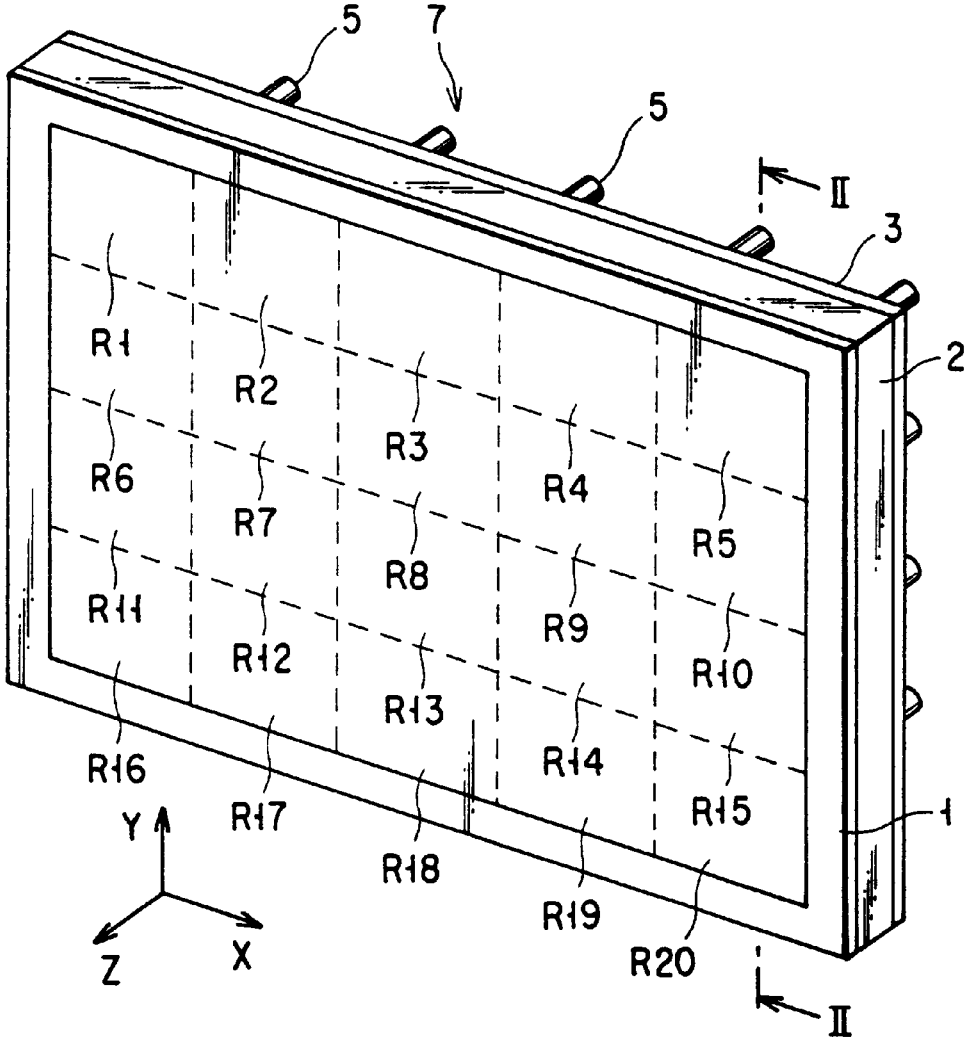
FIG. 1 is a perspective view showing a cathode ray tube according to a first embodiment of the present invention.
Figure 2:
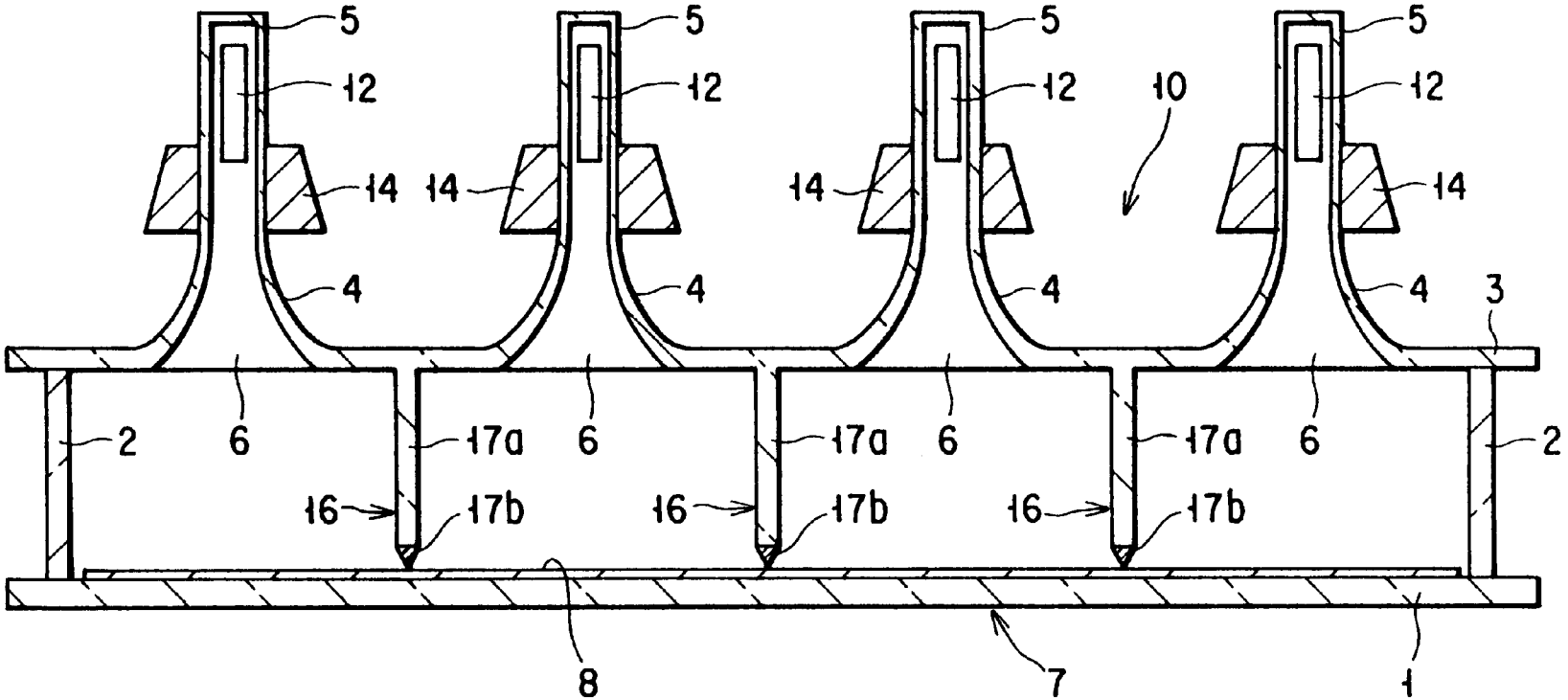
FIG. 2 is a cross-sectional view taken along a line II—II in FIG. 1.

As shown in FIGS. 1 and 2, the cathode ray tube comprises a vacuum envelope 7 which has a substantially rectangular flat face plate 1 made of glass, a frame-like side wall 2 joined to the periphery of the face plate 1 by a joining material such as frit glass and standing to be substantially perpendicular to the face plate 1, a substantially rectangular flat rear plate 3 opposing in parallel to the face plate 1 and joined to the face plate through the side wall 2 by a joining material such as frit glass, and a plurality of funnels 4 extending backwards from the rear plate 3. A total of 20 funnels 4 are arranged in a matrix array and for example, five funnels are arranged in rows in the horizontal direction (or X-direction) and four funnels are arranged in columns in the vertical direction (or Y-direction). An opening 6 of each funnel 4 is positioned in the same plane at the rear plate and is opposed to the inner surface of the face plate 1.

A phosphor screen 8 of an integrated structure is formed on the inner surface of the face plate 1 and the screen 8 includes stripe-shaped three-color phosphor layers each extending in the vertical direction Y to radiate in blue, green, and red, and black stripe provided between the three-color phosphor layers each other.

In the neck 5 of each funnel 4 is arranged an electron gun 12 for emitting electron beams toward the phosphor screen 8. The electron guns 12 functions as an electron emission section in the present invention. A deflector 14 is mounted on the outer circumference of each funnel 4.

Further, a plurality of plate support members 16 for supporting an atmospheric pressure applied to the face plate 1 and the rear plate 3 of the vacuum envelope 7 are arranged between the face plate 1 and the rear plate 3. Each plate support member 16 consists of a prismatic support body 17*a* and a wedge-shaped distal end portion 17*b* provided at the distal end of the support body.

The support body 17*a* is made of the same glass as the rear plate 3 and extends substantially perpendicular from the inner surface to the vicinity of the face plate 1. The distal end portion 17*b* is made of nickel alloy having a thermal expansion coefficient close to that of glass and is joined to the extending end of the support body 17*a* and kept in contact with the black stripe of the phosphor screen 8. In particular, each plate support members 16 is provided such that the top end portion 17*b* is in contact with a cross-point of boundaries between adjacent scanning regions of the phosphor screen 8.

By providing the plate support portions 16 constructed as described above, sufficient atmospheric-pressure resistance can be obtained even if the face plate 1, the side wall 2, and the rear plate 3 are each made of glass having a plate thickness of 4 to 15 mm, and the weight of the vacuum envelope 7 can be greatly reduced.

In the present embodiment, the rear plate 3, the plurality of funnels 4, and the support bodies 17*a* of the plate support members 16 are formed as an integrated structure made of glass and constitute a rear envelope 10. The vacuum envelope 7 is constructed by joining together the rear envelope 10 and the face plate 1 through the side wall 2.

In the cathode ray tube constructed as described above, electron beams emitted from the plurality of electron guns 12 are deflected by magnetic fields generated from the deflectors 14 mounted outside the funnels 4, respectively, to scan the phosphor screen 8 divided into a plurality of regions, e.g., total twenty regions R1 to R20 arranged in five rows in the horizontal direction and four columns in the vertical direction. Images displayed on the phosphor screen 8 by the divisional scanning are combined together by controlling signals applied to the electron guns 12 and the deflectors 14, and thus, a large image is reproduced over the entire surface of the phosphor screen 8 without seams and overlaps.

Next will be explained a method of manufacturing the cathode ray tube described above.

Figure 3:
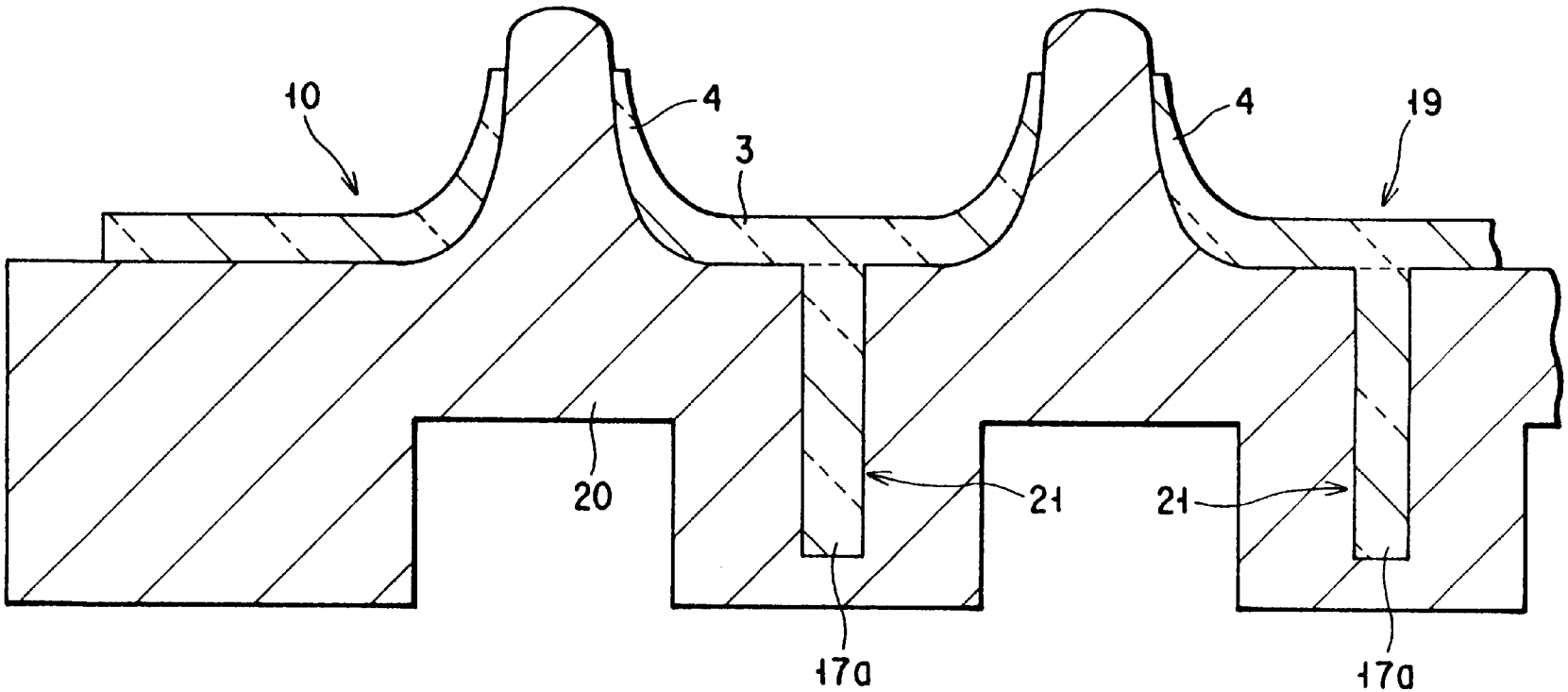
FIG. 3 is a cross-sectional view showing a manufacturing step of a rear envelope in the cathode ray tube.

At first, a rectangular sheet of plate glass 19 as a material for forming a rear plate 3 and a plurality of funnels 4, and twelve glass columns 21 as materials for respectively forming support bodies 17*a* of the plate support members 16 are prepared, as shown in FIG. 3. The plate glass 19 is formed in a size substantially equal to that of the face plate 1.

Subsequently, the plate glass 19 and the glass columns 21 are softened by heating them to a temperature equal to or higher than the softening point of glass, and are thereafter positioned along a shaping die 20 made of a heat-resistance material such as carbon or the like and having a predetermined shape. In this manner, the plate glass 19 is shaped along the shaping die 20, and a rear plate 3 integrally including a plurality of funnels 4 projecting therefrom is thus formed. The glass forming the funnels 4 is thinner at regions of the necks. Meanwhile, each glass column 21 has an end welded to a predetermined position on the inner surface of the rear plate 3, thereby forming the support bodies 17*a* integral with the rear plate. In this manner, the rear envelope 10 comprising the rear plate 3, the plurality of funnels 4, and the support bodies 17*a* is formed.

Figure 4:
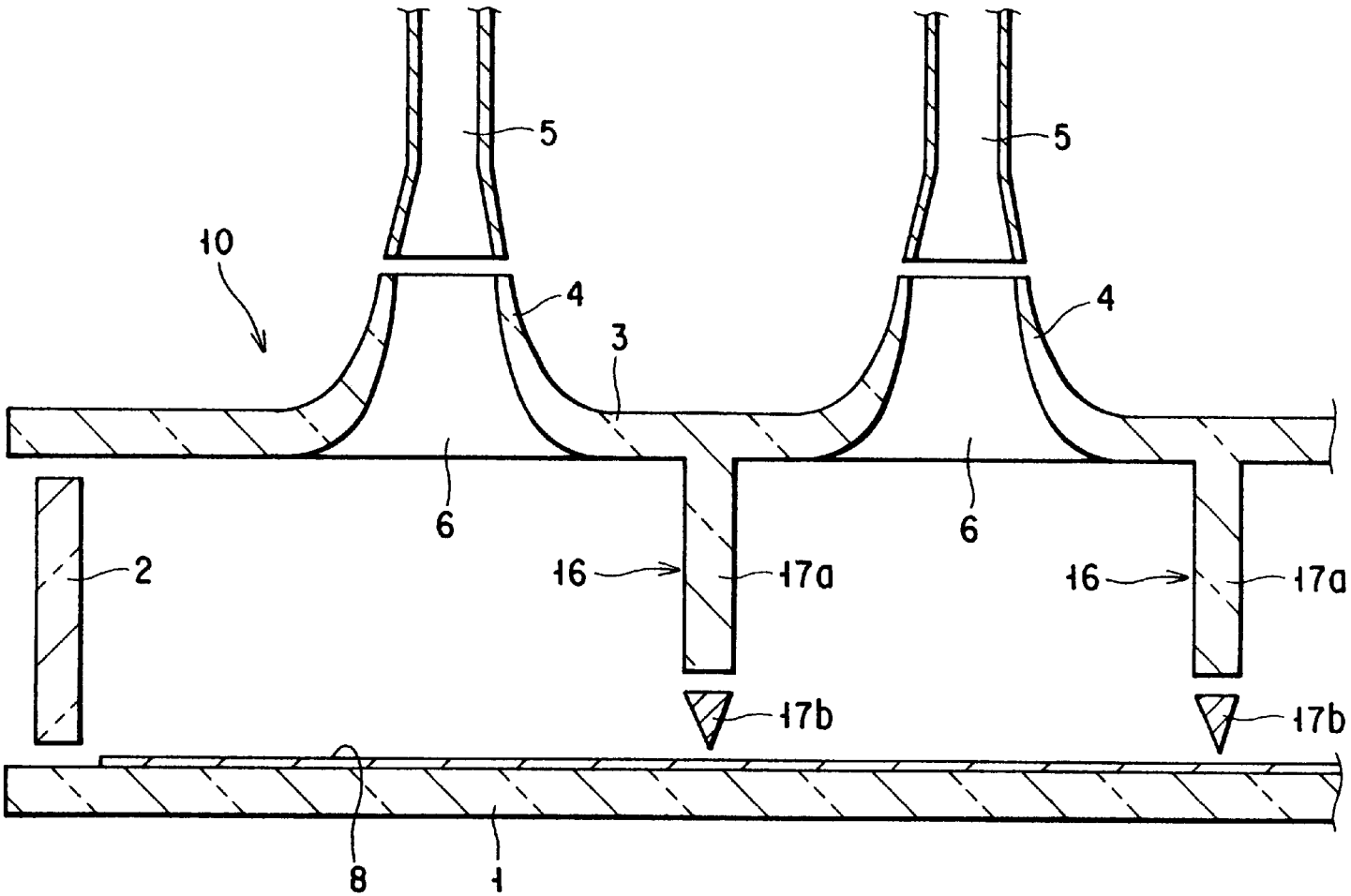
FIG. 4 is an exploded cross-sectional view showing the cathode ray tube.

Next, as shown in FIG. 4, the distal end portions 17*b* are positioned with respect to the extending ends of the support bodies 17*a*, using an assembly jig not shown, and the distal end portions 17*b* are joined to the support bodies 17*a* by applying and sintering frit glass. In this manner, twelve plate support members 16 are formed. Subsequently, a neck 5 processed like flare is connected to the top end of each funnel 4. In this case, the funnels 4 and the necks 5 are connected to each other by welding by heating with use of a burner. Thereafter, electron guns 12 are respectively enclosed in the plurality of necks 5.

Further, a phosphor screen 8 is formed on the inner surface of the face plate 1. Thereafter, the face plate 1, the side wall 2, and the rear envelope 10 are positioned by using an assembly jig not shown, and are joined integrally by applying and sintering frit glass, thereby forming a vacuum envelope 7. Thereafter, the vacuum envelope 7 is subjected to vacuum exhaustion and is equipped with deflectors 14, thus completing a cathode ray tube.

According to the cathode ray tube constructed as described above, the plurality of funnels 4 can be provided at predetermined positions with high precision by integrally forming the rear plate 3 and the plurality of funnels 4 from one plate glass, and finally, the positions of the electron guns 12 enclosed in the necks 5 of the funnels can respectively be set with high precision.

In an image display apparatus wherein a plurality of divided images are formed on a screen, as in the present embodiment, courses of electron beams actually emitted from the electron guns must be aligned with the respective axes (or normal axes) passing through the centers of corresponding regions, in order to hide seams between the divided images on the screen.

To align accurately the courses of the electron beams, the positional relationship between the electron guns 12 and the necks 5, the positional relationship between the rear envelope 10 and the face plate 1 (or the phosphor screen), and the relative positional relationship between the plurality of funnels 4 with each other must all be set with high precision.

High precision can be easily maintained with respect to the positional relationship between the electron guns 12 and the necks 5, since the electron guns can be sealed in the necks while correcting the positions of the guns at a normal temperature. Also, high precision can be easily maintained with respect to the positional relationship between the rear envelope 10 and the face plate 1, by joining the rear envelope 10 and the face plate 1 together by frit glass while pressing outline-reference positions of the envelope and the plate (e.g., three positions for each of the envelope and the plate) against reference pads of a sintering tool, in a manner similar to that used in a step of sealing/connecting a panel and funnels of a conventional cathode ray tube.

Further, the positional relationship between the plurality of funnels 4 is the positional relationship between the funnels 4 and the rear plate 3 constituting the rear envelope 10. In the present embodiment, since the rear plate and the funnels are integrally formed from a plate glass, the positions of the funnels 8 relative to each other depend on the processing precision of the shaping die used for shaping the rear envelope 10. With such processing precision, normal mechanical processing precision can be maintained.

Formation of the rear envelope 10 is carried out at a temperature equal to or higher than the softening point of glass, and therefore, a position shift caused by thermal expansions of glass and the shaping die appears as a problem. Since the position shift thus caused is constant based on the formation temperature and is easy to manage, no practical problem will be caused if only the shaping die is designed by previously estimating a shift amount. The positional relationship between the funnels and the reference surfaces 18 formed on the inner surface of the rear plate of the rear envelope 10 can be corrected by polishing or the like when processing the reference surfaces 18 after formation of the rear envelope 10.

The courses of electron beams are determined depending on emission positions and the emission angles thereof. The emission positions are layout positions of the electron guns, and the emission angles receive various influences from the precision of electrode arrangement of the electron guns, external magnetic fields, and the like. Therefore, even if the axis of an electron gun 12 is arranged at a predetermined position, the course of the electron beam does not always correspond to a predetermined course.

In this respect, a method of correcting the course of the electron beam using a ring magnet has been adopted conventionally. By variously combining the correction method using the magnet, the course of the electron beam can be corrected to some extent. It is, however, important that deformation of the shape of the electron beam is caused if this correction is used too much, and for example, an image of a high resolution cannot be reproduced. The present inventors have found that the position precision of an electron gun needs to be set to approximately 0.5 mm or less, in order to make correction relatively easily with high precision without influencing the beam shape of the electron beam.

In order that the position precision of the electron guns 12 satisfies the above numerical value, the position shift amount caused by a difference between the thermal expansion amounts of the shaping die of the rear envelope 10 and a glass material must be equal to or less than the numerical value described above. An actual position shift amount of 0.1 mm or less can be obtained, and it is thus possible to realize an image display apparatus having a vacuum envelope with high precision.

Also, according to the present embodiment, the vacuum envelope has less joining portions by integrally forming the rear plate 3, funnels 4, the support bodies 17*a*. The reliability concerning withstand-voltage characteristics, vacuum air-tightness, and the like is greatly improved, and materials and assembling steps associated with joining are reduced, so that manufacturing costs can be reduced.

If the funnels 4 are formed to be integral with the rear plate 3, each of the boundary portions between the inner surfaces of the funnels 4 and the inner surface of the rear plate can be formed as a continuous smooth arc surface. Therefore, electron beams emitted from the electron guns 12 do not collide into the periphery of the openings of the openings 6, but an excellent image can be displayed efficiently.

Meanwhile, according to the present embodiment, the support bodies 17*a* of the plate support members 16, which support an atmospheric pressure load applied to the vacuum envelope 7, are made of glass and are integrated with the rear plate 3 by welding. Therefore, a plurality of plate support members 16 can be arranged at predetermined positions of the rear plate 3 with high precision, and the heights of the plate support members can be uniformly aligned. Accordingly, it is possible to support efficiently an atmospheric pressure load which acts on the vacuum envelope by the plate support members, and a light-weight and strong image display apparatus can be realized.

Specifically, the plate support members 16 which support an atmospheric pressure load applied to the vacuum envelope 7 are provided on cross points between boundaries between adjacent regions of the phosphor screen 8, and therefore, positions of these members 16 in the horizontal and vertical directions must be precisely defined with respect to the phosphor screen. In order to efficiently support the atmospheric pressure load, the heights of the plate support members 16 must be aligned uniformly. Further, the plate support members 16 are subjected to various heat treatments during manufacturing steps and therefore may not cause differences by thermal deformations, thermal expansions, and the like. Particularly, if the plate support members 16 are long, a difference easily occurs between the thermal expansion amount of the plate support member and that of the side wall. To avoid such influences of thermal expansions, the entire plate support member may be made of nickel alloy having a thermal expansion coefficient close to that of glass. However, such nickel alloy is very expensive and provides only low process-ability.

According to the present embodiment, most part of each plate support member 16 is formed of a glass support body 17*a*, and only the distal end portion 17*b* is made of nickel alloy. Therefore, it is possible to avoid the problem caused by a thermal expansion and the other problems concerning prices and process-ability. Needless to say, the shorter the distal end portion 17*b* is, the smaller the influence of the plate support member on the thermal expansion is.

In the embodiment described above, the necks 5 are previously processed to be flared and are then welded to the funnels 14 when the necks 5 are joined to the funnels 4. This method is effective when the funnels 14 are formed of a thick plate glass or when the necks 5 having a small thickness are welded to the funnels. However, the necks need not always be flared but various methods can be selected in consideration of the process-ability of the necks.

In addition, the embodiment described above adopts a method in which the support bodies 17*a* and the distal end portions 17*b* are joined to each other by using frit glass. However, it is possible to adopt a method in which the support bodies and the distal end portions are fitted with each other. In this case, the distal end portions 17*b* can be made of other nickel alloy than.

In the first embodiment described above, the rear envelope 10 includes a rear plate 3, a plurality of funnels 4, and support bodies 17*a* of plate support members 16, which are integrally formed with each other. The rear envelope 10 may also include the side wall 2. In other words, the rear plate 3, the funnels 4, the support bodies 17*a*, and the side wall 2 may be integrally formed by a glass without using any joining material.

Figure 5:
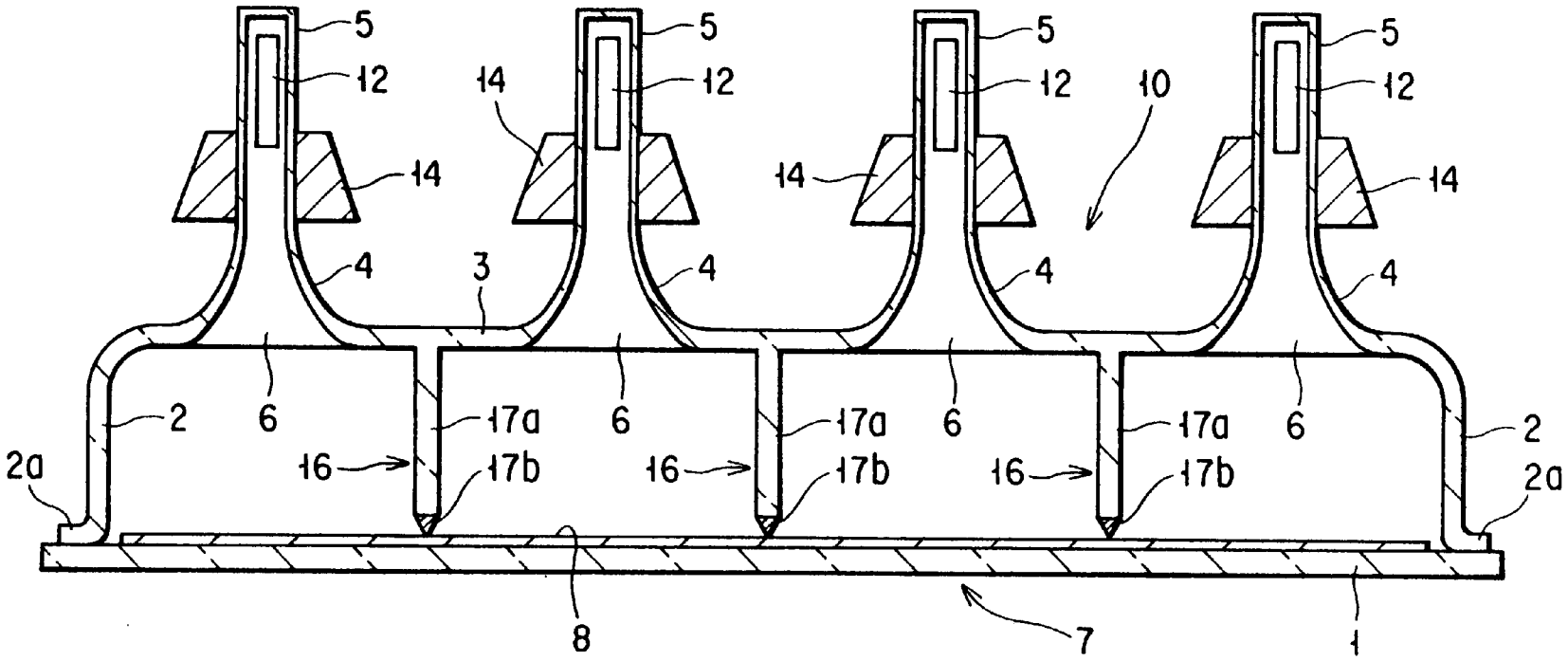
FIG. 5 is a cross-sectional view of a cathode ray tube according to a second embodiment of the present invention.

FIG. 5 shows a cathode ray tube according to a second embodiment of the present invention. In this cathode ray tube, a rear envelope 10 is a structure consisting of a side wall 2, a rear plate 3, funnels 4, and support bodies 17*a* which are integral with each other, and the structure is joined to a face plate 1 by a joining material, thereby forming a vacuum envelope. The end portion of the side wall 2 on the face plate side is bent outwards at substantially right angles, forming a flange 2*a*. The vacuum envelope 7 is formed by joining the flange 2*a* to the face plate 1 by frit glass.

The rest of the structure of the second embodiment is the same as those of the first embodiment. Those components which are the same as the components of the first embodiment are referred to by the same reference numerals, and detailed explanation of those components will be omitted.

Figure 6:
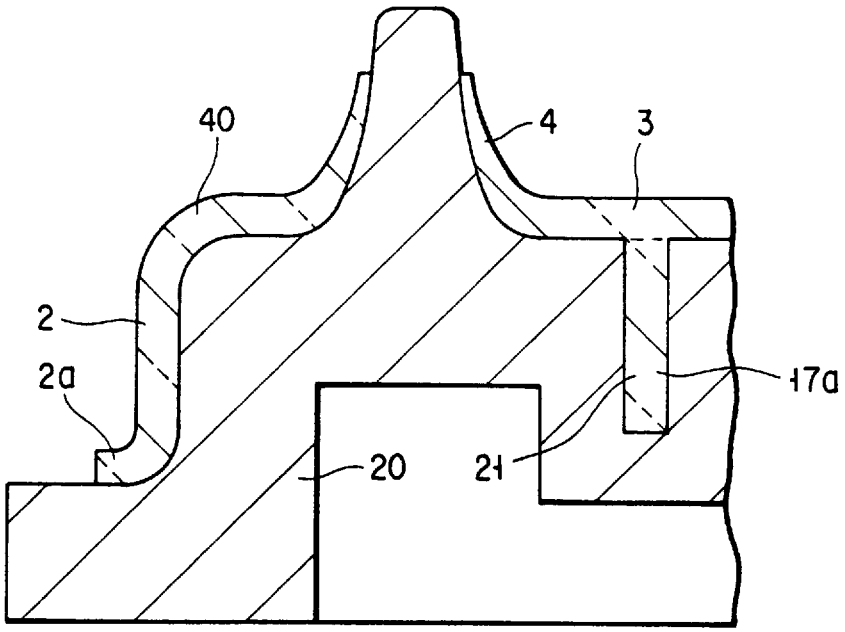
FIG. 6 is a cross-sectional view showing a manufacturing step of a rear envelope of the cathode ray tube according to the second embodiment.

In case of manufacturing a cathode ray tube comprising the rear envelope 10 constructed as described above, as shown in FIG. 6, a sheet of plate glass 40 as a material for forming the rear envelope 10 and glass columns 21 as materials for forming the support bodies 17*a* are heated to a temperature equal to or higher than the softening point of glass and are softened thereby. The softened plate glass 40 is positioned along a shaping die 20 made of carbon and processed into a predetermined shape. In this manner, the plate glass 40 is shaped along the shaping die 20, and a rear plate 3 integrally including a sided wall 2 and a plurality of funnels 4 projecting therefrom is thus formed. The glass forming the funnels 4 is thinner at regions near the necks. Meanwhile, each glass column 21 has an end welded to a predetermined position on the inner surface of the rear plate 3, thereby forming the support bodies 17*a* integral with the rear plate. In this manner, the rear envelope 10 comprising the side wall 2, the rear plate 3, the plurality of funnels 4, and the support bodies 17*a* is formed.

Figure 7:
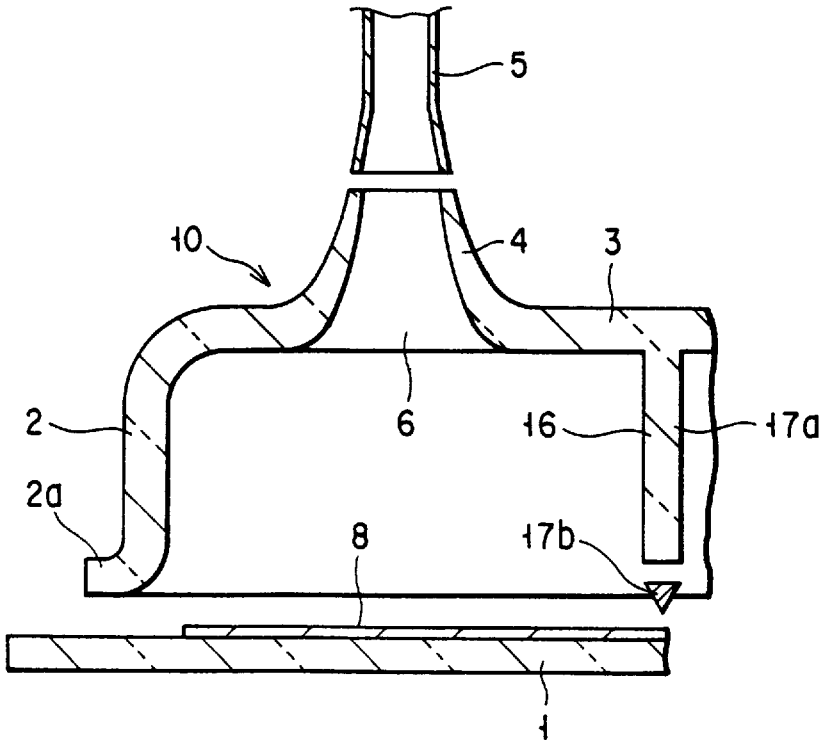
FIG. 7 is an exploded cross-sectional view showing the cathode ray tube according to the second embodiment.
Figure 8:
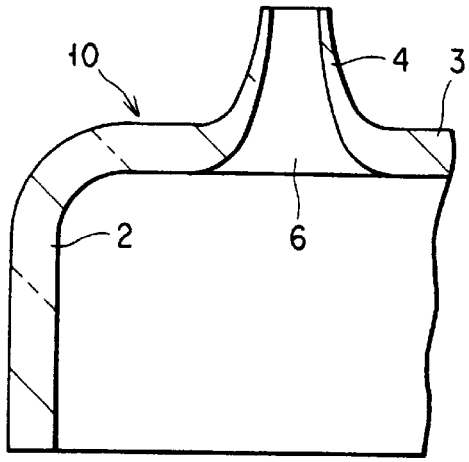
FIG. 8 is a cross-sectional view showing a modification of the cathode ray tube according to the second embodiment.

Next, as shown in FIG. 7, distal end portions 17*b* are positioned with respect to the extending ends of the support bodies 17*a*, using an assembly jig not shown, and the distal end portions 17*b* are joined to the support bodies 17*a* by applying and sintering frit glass. In this manner, twelve plate support members 16 are formed. Subsequently, a neck 5 previously processed and flared is connected to the distal end of each funnel 4. In this case, the funnels 4 and the necks 5 are connected to each other by welding by heating with use of a burner. Thereafter, electron guns 12 are respectively sealed in the plurality of necks 5.

Further, a phosphor screen 8 is formed on the inner surface of the face plate 1, and the peripheral portion of the inner surface of the face plate 1 is integrally joined to a flange 2*a* of the side wall 2 by applying and sintering frit glass, thereby forming a vacuum envelope 7. Thereafter, the vacuum envelope 7 is subjected to vacuum exhaustion and is equipped with deflectors 14, thus completing a cathode ray tube.

According to the second embodiment constructed as described above, it is possible to obtain the same advantages and effects as those of the first embodiment. Also, according to the present embodiment, since the side wall 2 is constructed to be integral with the rear plate, the funnels, and the support bodies, joining portions using a joining material are reduced much more so that an image display apparatus having withstand voltage characteristics and vacuum-air-tightness improved much more can be obtained, compared with the first embodiment. At the same time, materials and manufacturing steps associated with joining are reduced so that manufacturing costs can be reduced much more.

Further, according to the present embodiment, the end portion of the side wall 2 is bent outwards, forming the flange 2*a*. Therefore, the contact area between the side wall 2 and the face plate 1 is increased, so that a sufficient joining width can be obtained and flatness of contact portions therebetween can be ensured.

Note that the end portion of the side wall 2 needs not be formed like a flange but may be formed linearly. In this structure, it is possible to obtain advantages and effects substantially equal to those of the second embodiment.

The second embodiment adopts a structure in which the rear plate 3, the funnels 4, and the side wall 2 are integrally formed of a sheet of plate glass. However, a rear envelope of an integrated structure may be constructed by welding together a rear plate and funnels integrally formed of a sheet of plate glass, a side wall formed of another plate glass, and support bodies 17*a*.

Figure 9:
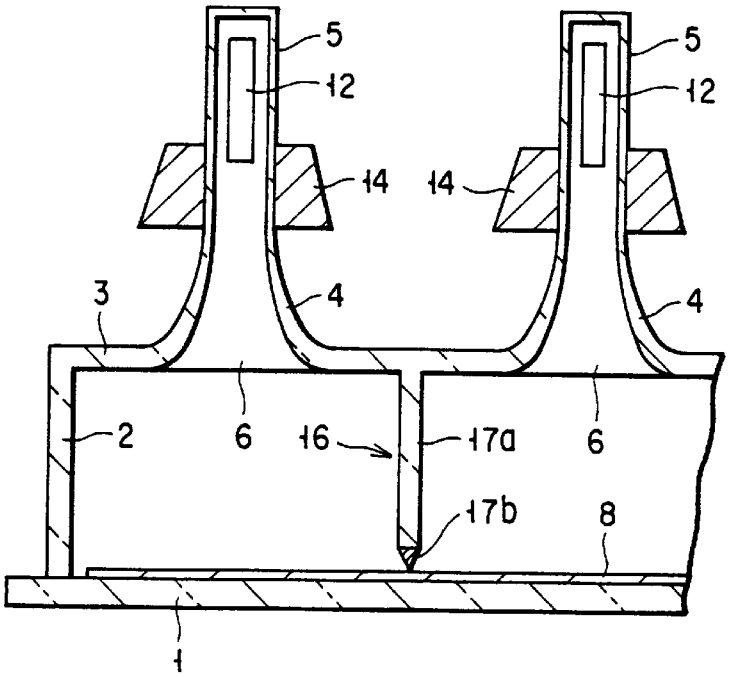
FIG. 9 is a cross-sectional view showing a cathode ray tube according to a third embodiment of the present invention.

FIG. 9 shows an image display apparatus according to a third embodiment, in which a rear envelope 10 is formed as an integrated structure including a rear plate 3, funnels 4, a side wall 2, and support bodies 17*a*. In this case, the side wall 2 and the support bodies 17*a* are integrated with the rear plate 3 by welding.

An image display apparatus comprising such a rear envelope 10 is manufactured by the method as follows.

Figure 10:
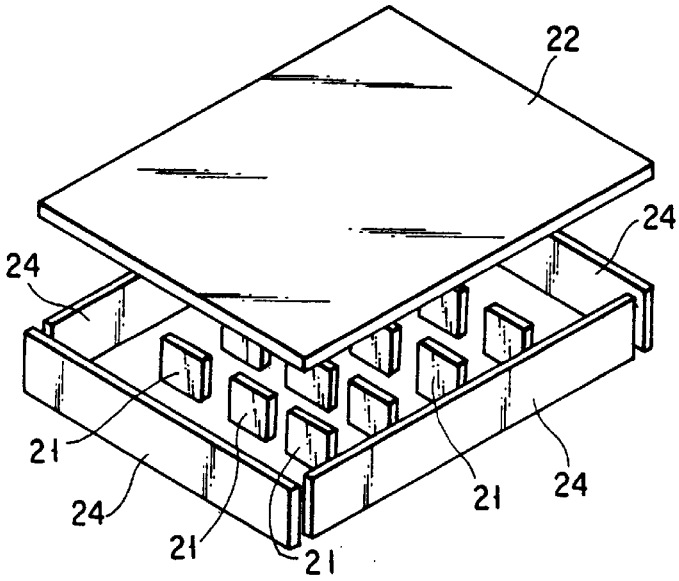
FIG. 10 is an exploded perspective view showing plate glass used for manufacturing a rear envelope of the cathode ray tube according to the third embodiment.

As shown in FIG. 10, the rear envelope 10 is processed from a sheet of plate glass 22 as a material for a rear plate 3 and a plurality of funnels 4, four long sheets of rectangular plate glasses 24 as materials for a side wall 2, and twelve glass columns 21 as materials for support bodies 17*a*. The plate glass 22 has a size substantially equal to the face plate 1. The plate glasses 24 have a strip shape, and two of them are prepared for short sides while the other two are prepared for long sides of the side wall 2.

Figure 11:
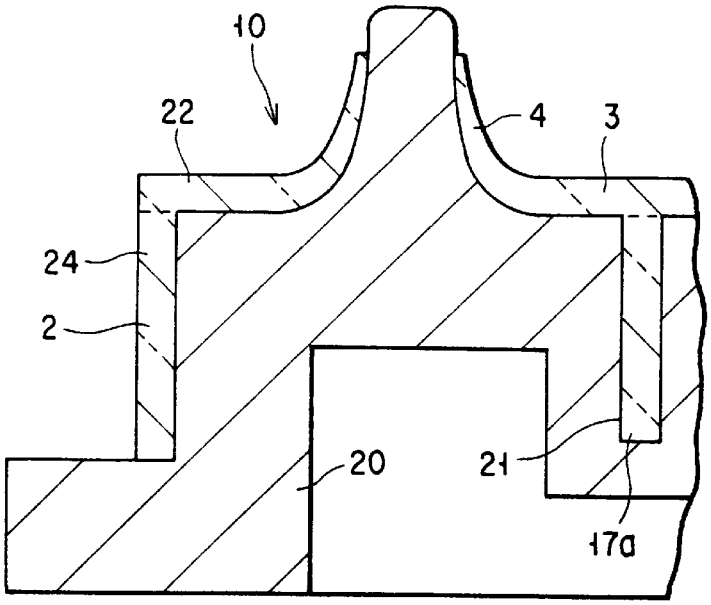
FIG. 11 is a cross-sectional view showing a manufacturing step of a rear envelope according to the third embodiment.

Subsequently, these five glasses 22 and 24 and twelve glass columns 21 are heated to a temperature equal to or higher than the softening point of glass and are softened thereby. Thereafter, as shown in FIG. 11, the softened glasses are positioned along a shaping die 20 made of a heat-resistive material such as carbon or the like. In this manner, funnels 4 and a rear plate 3 are formed from the plate glass 22, and end portions of the four plate glasses 24 are welded to each other. Simultaneously, the four plate glasses 24 are welded to the peripheral portion of the inner surface of the plate glass 22. Further, an end of each glass column 21 is welded to the inner surface of the rear plate 3. In this manner, the rear envelope 10 comprising the rear plate 3, the plurality of funnels 4, the side wall 2, and the support bodies 17*a* is formed.

Thereafter, joining of distal end portions 17*b*, connection of necks, formation of a phosphor screen, joining of a face plate, exhaustion of a vacuum envelope, and installation of deflectors are carried out in a manner similar to the embodiment described above, and thus, a cathode ray tube is manufactured.

According to the third embodiment constructed as described above, it is possible to obtain the same advantages and effects as those of the second embodiment. In addition, according to the present embodiment, since the side wall 2 is not formed to be integral with the rear plate 3 at a high temperature, but is formed welding together four sheets of plate glasses 24 which are previously cut in a strip shape. Therefore, it is possible to form the rear envelope more easily compared with the second embodiment.

Specifically, in case of forming a rear plate, funnels, and a side wall by shaping one sheet of plate glass, as in the second embodiment, the side wall can be processed by bending the plate glass, and therefore, the rear envelope can be formed efficiently. However, glass is excessive at bending portions, e.g., at corner portions, and such excessive glass must be released to the periphery during the bending processing or cut out later. The excess of glass increase in proportion to the height of the side wall. Therefore, the manufacturing method shown in the second embodiment is rather effective where the side wall is low, but this method requires a long annealing time where the side wall is high since the thickness distribution of glass is rendered ununiform due to excessive glass, thereby making the heat capacity ununiform.

In contrast, according to the third embodiment, the side wall is formed of plate glasses specialized for the side wall by cutting only necessary portions. No excessive glass remains from the manufacturing steps, and it is possible to provide a manufacturing method suitable for manufacturing a cathode ray tube having a high side wall. Also, according to the present embodiment, glass may have a viscosity substantially enough to self-welding and processing can be carried out at a relatively low temperature, since processing for greatly deforming a plate glass is not required.

Figure 12:
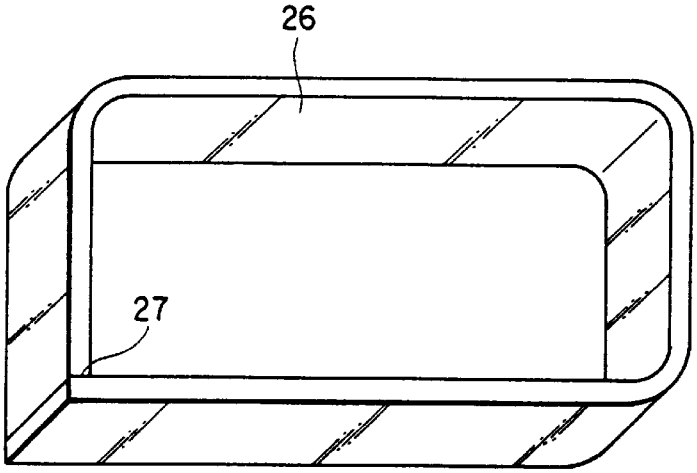
FIG. 12 is a perspective view showing plate glass used for manufacturing a rear envelope of a cathode ray tube according to the fourth embodiment.
Figure 13:
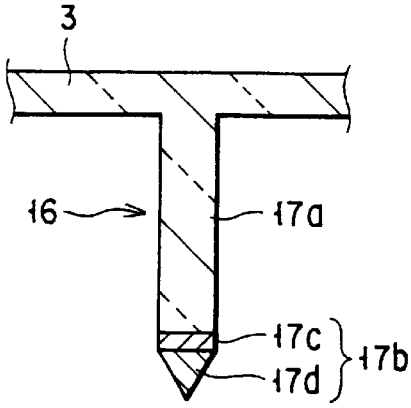
FIG. 13 is a cross-sectional view showing a modification of a plate support member of a cathode ray tube according to the present invention.
Figure 14:
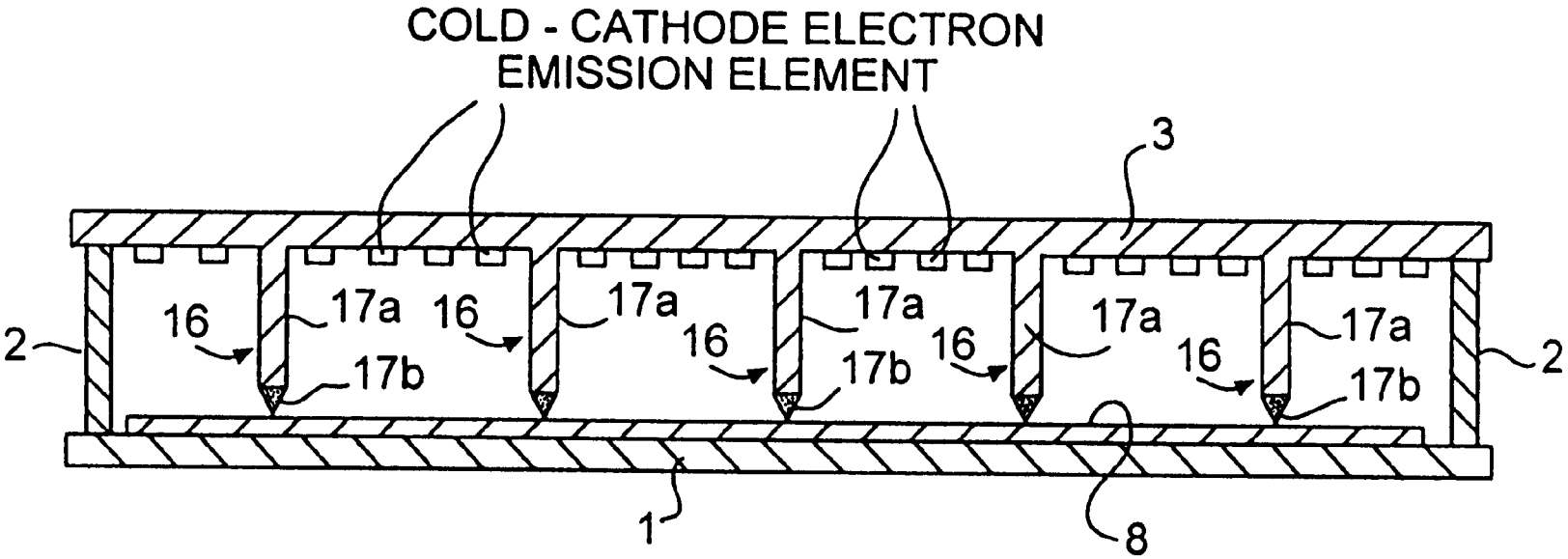
FIG. 14 is a cross-sectional view showing of a cathode ray tube according to a fourth embodiment of the present invention

Although the third embodiment described above uses four plate glasses to form a side wall, it is possible to form the side wall by bending a long strip-like plate glass 26 as in a fourth embodiment shown in FIG. 12.

Specifically, the plate glass 26 is shaped to have a length substantially equal to the total length of the side wall 2. Further, as shown in FIG. 12, the plate glass 26 heated to a high temperature is bent and processed into a rectangular frame-like shape, and the end portions of the plate glass 26 are brought into contact with each other. In this case, the plate glass 26 is heated around the vicinities of the bending portions by a burner and is bent in a predetermined shape by a metallurgical jig.

Subsequently, like in the third embodiment, a rectangular sheet of plate glass as a material for forming a rear plate 3 and a plurality of funnels 4, glass columns as materials for forming support bodies, and the plate glass 26 processed and bent as described above are heated to a temperature equal to or higher than the softening point of glass and are softened thereby. Thereafter, the softened glasses are positioned along a shaping die made of a heat-resistive material. In this manner, a rear plate 3 comprising funnels 4 is formed from the plate glass 22, and the end portions of the plate glass 26 are welded to each other. Simultaneously, the plate glass 26 is welded to the peripheral portion of the inner surface of the rear plate. Further, an end of each glass column is welded to the inner surface of the rear plate 3. In this manner, a rear envelope 10 comprising the rear plate 3, the plurality of funnels 4, the side wall 2, and the support bodies 17*a* is formed.

The rest of the structure of the present embodiment is the same as the third embodiment. In the fourth embodiment constructed as described above, it is possible to obtain the same advantages and effects as those of the third embodiment.

In the embodiments described above, each of the plate support members 16 consists of a support body 17*a* made of glass and a distal end portion 17*b* made of nickel alloy. However, each of the distal end portions 17*b* may consist of first and second portions. Specifically, according to the structure shown in FIG. 3, each of the distal end portions 17*b* consists of a first portion 17*c* joined to the extending end of the support body 17*a*, and a wedge-shaped second portion 17*d* joined to the first portion. For example, each first portion 17*c* is made of metal having a thermal expansion coefficient close to that of glass, and each second portion 17*d* in contact with a black stripe of a phosphor screen is made of metal having higher hardness.

In case where the plate support member 16 constructed as described above are used, the strength of the vacuum envelope against the atmospheric pressure load can be more improved and those portions thereof which are in contact with the phosphor screen can be positioned with high precision.

The present invention is not limited to the embodiments described above, but may further be modified within the scope of the invention. For example, the present invention is applicable to a cathode ray tube adopting a different method, such as a cathode ray tube comprising a shadow mask, a cathode ray tube of a beam index type, or the like, although the above embodiments have been explained with reference to a cathode ray tube having no shadow mask.

Further, the image forming apparatus according to the present invention is not limited to a cathode ray tube, but the present invention is applicable to an image forming apparatus, for instance, which comprises a cold-cathode electron emission element as an electron emission section and does not have funnels or necks.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image display apparatus comprising:

an envelope including a substantially rectangular flat face plate having a phosphor screen formed on an inner surface thereof, a substantially rectangular flat rear plate opposed to the face plate with a side wall being interposed therebetween, and a plurality of plate support portions arranged between the rear plate and the face plate, for supporting the rear plate and the face plate against an atmospheric pressure;

an electron emission section positioned in the rear portion of the envelope, for emitting an electron toward the phosphor screen; and each of the plate support portions including a support body made of glass which is integrally welded to the rear plate without the aid of an intermediate material and extends from the rear plate toward the face plate.

2. An image display apparatus according to claim 1, wherein each of the plate support portions includes a distal end portion joined to an extending end of the support body and contacting the phosphor screen.

3. An image display apparatus according claim 2, wherein each of the distal end portions includes a first portion joined to the extending end of the support body, and a second portion joined to the first portion and kept in contact with the phosphor screen.

4. An image display apparatus according to claim 2, wherein the distal end portions are made of metal.

5. An image display apparatus according to claim 1, wherein the envelope includes a plurality of funnels extending from the rear plate, and a plurality of necks extending from the respective funnels, and the electron emission section has a plurality of electron guns arranged in the respective necks.

6. An image display apparatus according to claim 5, wherein a boundary portion between an inner surface of the rear plate opposed to the face plate and an inner surface of each of the funnels is formed in a continuous arc shape.

7. An image display apparatus according to claim 5, wherein the rear plate and the plurality of funnels are integrally formed of a single plate glass, and constitute a rear envelope together with the support bodies, and the rear envelope is joined to the face plate through the side wall.

8. An image display apparatus according to claim 7, wherein the side wall consists of an elongate rectangular plate glass bent in a frame-like shape and welded to the rear plate.

9. An image display apparatus according to claim 7, wherein the side wall is formed to be integral with the rear plate and forming the rear envelope, and the side wall of the rear envelope is joined to the face plate.

10. An image display apparatus according to claim 7, wherein the side wall includes four rectangular plate glasses welded to the rear plate and welded to each other.

11. An image display apparatus according to claim 9, wherein the rear plate, the plurality of funnels, and the side wall are integrally formed of a single plate glass and constitute the rear envelope.

12. An image display apparatus according to claim 11, wherein the side wall comprises a flange bent outwards and joined to the face plate.

13. An image display apparatus according to claim 1, wherein the electron emission section has a plurality of cold-cathode electron emission elements provided on the rear plate.

14. An image display apparatus according to claim 13, wherein the side wall is formed to be integral with the rear plate so as to constitute a rear envelope, and is joined to the face plate.

15. An image display apparatus according to claim 14, wherein the rear plate and the side wall are integrally formed of a single plate glass and constitute the rear envelope.

16. An image display apparatus according to claim 14, wherein the side wall includes four rectangular plate glasses welded to the rear plate and welded to each other.

17. An image display apparatus according to claim 14, wherein the side wall consists of an elongate rectangular plate glass bent in a frame-like shape and welded to the rear plate.

18. A method of manufacturing an image display apparatus including a substantially rectangular flat face plate having a phosphor screen formed on an inner surface thereof, a substantially rectangular flat rear plate opposed to the face plate with a side wall being interposed therebetween, a plurality of plate support portions arranged between the rear plate and the face plate to support the rear plate and the face plate against an atmospheric pressure, and an electron emission section positioned in the rear of the envelope, for emitting an electron toward the phosphor screen, the method comprising the steps of:

heating support bodies of the plate support portions and the rear plate, made of glass, to a temperature equal to or higher than a softening point of glass, to weld an end of each of the support bodies to an inner surface of the rear plate without the aid of an intermediate material.

19. A method according to claim 18, which further comprises a step of joining a distal end portion, which is to be in contact with the phosphor screen, to another end of each of the welded support body, thereby constituting the plate support portion.

20. A method according to claim 18, further comprising the steps of:

integrally forming the rear plate and a plurality of funnels from a single plate glass, and welding the support bodies to the rear plate, so as to manufacture a rear envelope; and joining the rear envelope to the face plate by a joining material, with the side wall being interposed therebetween.

21. A method according to claim 20, wherein the step of manufacturing the rear envelope includes a step of heating and softening the support bodies and a plate glass having a size substantially equal to the face plate, and a step of integrally forming the rear plate and the plurality of funnels and welding the support bodies, by positioning the plate glass and the support bodies thus softened, along a shaping die having a predetermined shape.

22. A method according to claim 18, further comprising the step of integrally forming the rear plate, a plurality of funnels, and the side wall from a single plate glass.

23. A method according to claim 18, further comprising the step of integrally forming the rear plate, and a plurality of funnels from a single plate glass, a step of welding four rectangular plate glasses to each other to form a frame-like side wall, and a step of welding and integrating the frame-like side wall to the rear plate.

24. A method according to claim 18, further comprising the step of integrally forming the rear plate and a plurality of funnels from a single plate glass, a step of bending an elongate rectangular plate glass into a frame-like shape to form a frame-like side wall, and a step of welding and integrating the frame-like side wall to the rear plate.

25. An image display apparatus comprising:

an envelope including a substantially rectangular flat face plate having a phosphor screen formed on an inner surface thereof, a substantially rectangular flat rear plate opposed to the face plate with a side wall being interposed therebetween, a plurality of funnels extending from the rear plate, a plurality of necks extending from the respective funnels, and a plurality of plate support portions arranged between the rear plate and the face plate, for supporting the rear plate and the face plate against an atmospheric pressure;

a plurality of electron guns respectively arranged in the necks, for dividedly scanning a plurality of regions of the phosphor screen by electron beams; and each of the plate support portions including a support body made of glass which extends from the rear plate toward the face plate, the rear plate and the plurality of funnels being integrally formed of a single plate glass.

26. An image display apparatus comprising:

an envelope including a substantially rectangular flat face plate having a phosphor screen formed on an inner surface thereof, a substantially rectangular flat rear plate opposed to the face plate with a side wall being interposed therebetween, and a plurality of plate support portions arranged between the rear plate and the face plate, for supporting the rear plate and the face plate against an atmospheric pressure, the rear plate and the side wall being integrally formed of a single plate glass;

an electron emission section provided on the rear plate, for emitting an electron toward the phosphor screen; and each of the plate support portions including a support body made of glass which is integrally welded to the rear plate without the aid of an intermediate material and extends from the rear plate toward the face plate.

* * * * *